US009149127B2

(12) United States Patent
Manouchehri et al.

(10) Patent No.: US 9,149,127 B2
(45) Date of Patent: Oct. 6, 2015

(54) CRIB VENTILATION APPARATUS

(71) Applicants: Sandra Manouchehri, Burbank, CA (US); Michael A Parness, Foxfield, CO (US)

(72) Inventors: Sandra Manouchehri, Burbank, CA (US); Michael A Parness, Foxfield, CO (US)

(73) Assignee: Sanmi, Inc., Burbank, CA (US)

( * ) Notice: Subject to any disclaimer, the term of this patent is extended or adjusted under 35 U.S.C. 154(b) by 0 days.

(21) Appl. No.: 14/451,751

(22) Filed: Aug. 5, 2014

(65) Prior Publication Data

US 2015/0173522 A1 Jun. 25, 2015

Related U.S. Application Data

(60) Provisional application No. 61/918,580, filed on Dec. 19, 2013.

(51) Int. Cl.

| | |
|---|---|
| ***A47C 21/04*** | (2006.01) |
| ***A47D 9/00*** | (2006.01) |
| ***A47D 15/00*** | (2006.01) |

(52) U.S. Cl.

CPC ..... *A47C 21/044* (2013.01); *A47D 9/00* (2013.01); *A47D 15/00* (2013.01)

(58) Field of Classification Search

CPC ..... A47D 9/00; A47D 15/00; A47D 13/06; A47C 21/04; A47C 21/042; A47C 21/044; A47C 21/048

USPC ..... 5/284, 421, 423, 424, 93.1, 97; 62/261; 219/217

See application file for complete search history.

(56) References Cited

U.S. PATENT DOCUMENTS

| | | | | |
|---|---|---|---|---|
| 3,878,570 | A * | 4/1975 | Donnelly | 5/97 |
| 5,389,037 | A * | 2/1995 | Hale | 454/284 |
| 5,592,704 | A * | 1/1997 | Breese | 5/423 |
| 5,730,120 | A * | 3/1998 | Yonkers, Jr. | 128/202.13 |
| 6,052,853 | A * | 4/2000 | Schmid | 5/726 |
| 8,414,347 | B2 * | 4/2013 | Achan et al. | 446/178 |
| 9,044,101 | B2 * | 6/2015 | Garcia et al. | 1/1 |
| 2007/0243791 | A1 * | 10/2007 | Stedman | 446/227 |
| 2010/0125949 | A1 * | 5/2010 | Stebbing | 5/423 |
| 2014/0208511 | A1 * | 7/2014 | Glazman | 5/603 |

FOREIGN PATENT DOCUMENTS

| | | | | |
|---|---|---|---|---|
| GB | 2467307 A * | 8/2010 | | F04D 25/08 |
| WO | WO 0139634 A1 * | 6/2001 | | |

* cited by examiner

*Primary Examiner* — Michael Trettel

(74) *Attorney, Agent, or Firm* — Stetina Brunda Garred & Brucker

(57) ABSTRACT

A circulation unit is provided including a dual-fan unit having a first fan and a separate second fan. The first fan is configured to draw in fresh air from the ambient environment and direct the fresh air into the crib, while the second fan is configured to draw in dangerous gas from the crib and expel the dangerous gas to the ambient environment. The dual fan unit is fluidly coupled to a venting unit via a pair of fluid conduits. The venting unit is placeable within the crib, while the dual fan unit is placeable outside of the crib so as to distance the infant from electrical components and potentially harmful mechanical components, such as the fans.

20 Claims, 8 Drawing Sheets

CRIB VENTILATION APPARATUS

CROSS-REFERENCE TO RELATED APPLICATIONS

This application claims the benefit of U.S. Provisional Application No. 61/918,580, filed Dec. 19, 2013, the contents of which are expressly incorporated herein by reference.

STATEMENT RE: FEDERALLY SPONSORED RESEARCH/DEVELOPMENT

Not Applicable

BACKGROUND OF THE INVENTION

1. Technical Field of the Invention

The present disclosure generally relates to an air circulating device, and more specifically to an air circulating device for flushing dangerous gases, such as carbon dioxide, from a crib and supplying fresh oxygenated air into the crib.

2. Description of the Related Art

One of the primary concerns for parents is the health and safety of their child. The medical field is well aware of several health conditions which may afflict children, and in the case of most health conditions, the medical field has identified a root cause which triggers that particular health condition. However, one of the more worrisome health conditions that plague young children is Sudden Infant Death Syndrome (SIDS), which is associated with the sudden death of an infant and remains unexplained after a thorough autopsy and death scene investigation, as well as a review of the clinical history. In this regard, SIDS differs from several other medical conditions because the cause remains unknown.

Despite the causes of SIDS being unknown, recent studies have indicated that the addition of a fan within the child's nursery may help reduce the likelihood that an infant may suffer from SIDS. Researchers believe that fans may promote circulation of fresh air, which mitigates the chances of an infant breathing exhaled carbon dioxide, which could lead to suffocation.

Poor air circulation within the crib may be worsened when the crib is outfitted with crib bumpers. Typical crib bumpers range from about 6" to about 10" in height and are typically fabricated from a sponge, rubber or polymer material and having a covering of material such as fabric, polymer sheeting or the like. The bottom edge of the conventional crib bumper, in essence, creates a seal with the upper surface of crib mattress so that concentrations of dangerous heavy gasses, such as carbon dioxide, collect within the crib in the region where the infant will lie. In this regard, the bumper effectively forms a substantially confined space, similar to a shallow pool, such that if there is poor air circulation in the infant's room, the oxygen supply to the infant may be inadequate for optimum healthy conditions.

Conventional fans are well-known and are capable of circulating air. However, the conventional fan may cause more harm than good when placed in an infant's nursery. For instance, many commercially available fans are intended to cool a large area or an entire room, and thus, the use of such fans to circulate fresh air for purposes of reducing the incidence of SIDS may overcool the infant, thereby adversely impacting the baby's health. Moreover, the noise from many commercially available fans may disturb the sleeping infant. Another drawback to most conventional fans is that they include sharp blades which rotate at high speeds and pose a safety risk to the infant if the fan is located within or near a baby's crib. The sharp fan blades may cut or injure the baby's limbs, toes or fingers. Conventional fans may also raise a strangulation and/or an electrocution concern if the fan includes a power cord that is within reach of the infant. As such, conventional fans tend to be too powerful, too loud and tend to create too many safety concerns.

Accordingly, there is a need in the art for a device that can safely and effectively circulate air near an infant so as to flush carbon dioxide away from the infant without presenting sharp blades or dangerous power cords within reach of an infant located within a crib. Various aspects of the present invention are directed toward addressing these needs, as will be discussed in more detail below.

BRIEF SUMMARY OF THE INVENTION

Various aspects of the present invention are directed toward a circulation unit configured and adapted to induce fluid circulation within a crib to flush out dangerous gases, such as carbon dioxide, which may accumulate near the surface of the crib mattress over time, and replenish that area with fresh air. The circulation unit is specifically configured and adapted to create the aforementioned circulation while minimizing injury concerns associated with the circulation unit.

According to one embodiment, the circulation unit includes a dual-fan unit including a first fan and a separate second fan. The first fan is configured to draw in fresh air from the ambient environment and direct the fresh air into the crib, while the second fan is configured to draw in potentially harmful/dangerous gas from the crib and expel the dangerous gas to the ambient environment. The dual fan unit is fluidly coupled to a venting unit via a pair of fluid conduits. The venting unit is placeable within the crib, while the dual fan unit is placeable outside of the crib so as to distance the infant from electrical components and potentially harmful mechanical components, such as the fans.

The circulation unit may include a microprocessor for enabling programmable operation of the circulation unit. The microprocessor may be in communication with a wireless communication module for enabling remote monitoring or operation of the circulation unit. The circulation unit may be configured to operate in connection with a software application downloadable onto a remote computing device to enable remote monitoring and operation. The microprocessor may also be in communication with one or more sensors which sense local environmental parameters.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION OF THE INVENTION

Figure 1:
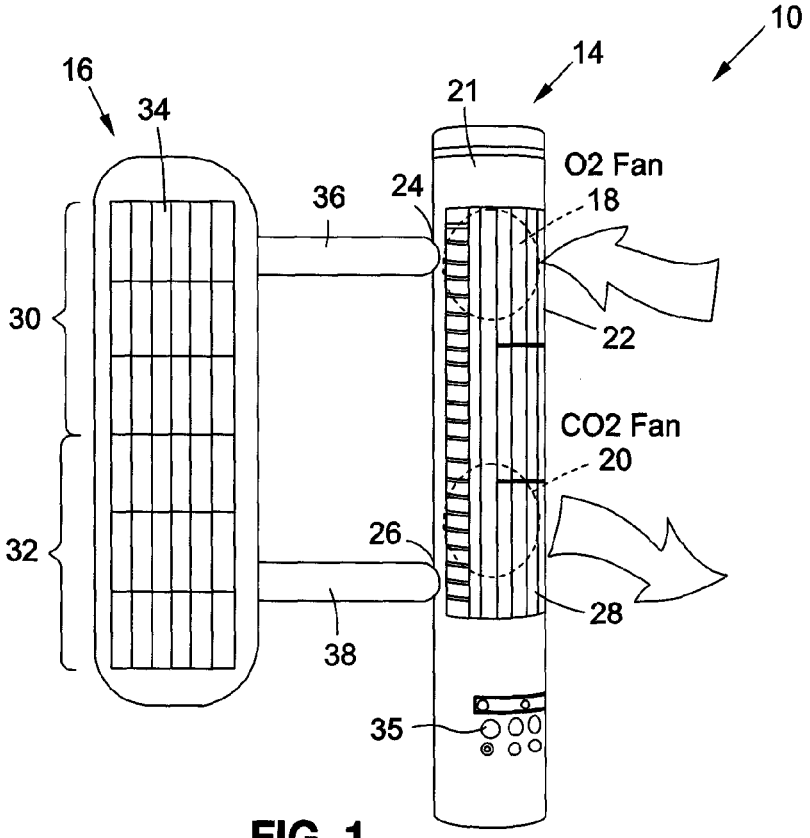
FIG. 1 is a front view of a first embodiment of a circulation unit having a dual fan unit and a separate venting unit.

Referring now to the drawings, wherein the drawings are for purposes of illustrating a preferred embodiment of the present invention only, and are not for purposes of limiting the same, there is depicted a circulation unit 10 for circulating air within a crib 12 to reduce the likelihood that an infant laying within the crib 12 suffers from Sudden Infant Death Syndrome (SIDS). The circulation unit 10 is specifically configured and adapted to generate air circulation within the crib 12 without introducing sharp or unsafe blades within close proximity to the child within the crib 12. Furthermore, the circulation unit 10 is configured to mitigate any strangulation concern either by eliminating any electrical cord or distancing the electrical cord from the child within the crib 12, such that the electrical cord is out of reach.

Figure 2:
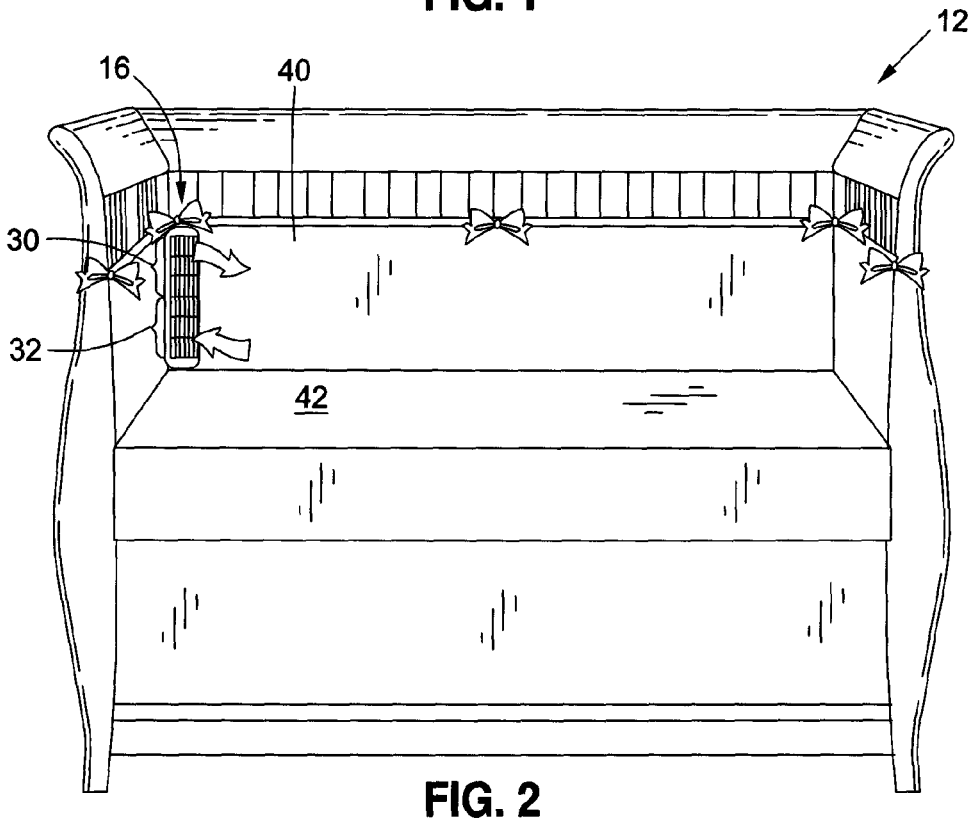
FIG. 2 is a front view of the circulation unit coupled to a crib with the venting unit positioned within the crib.
Figure 3:
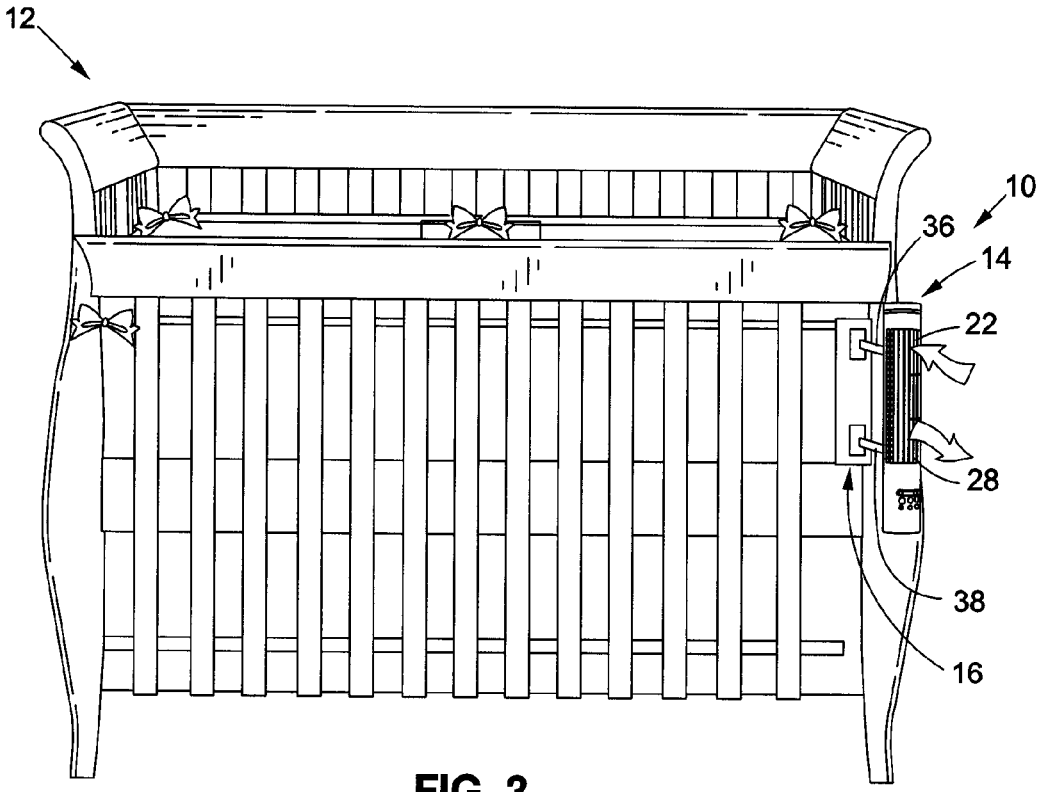
FIG. 3 is a rear view of the circulation unit coupled to the crib with the dual fan unit positioned outside the crib.

Referring now specifically to FIGS. 1-3, there is shown a first embodiment of a circulation unit 10 comprised of a dual fan unit 14 and a separate venting unit 16. The dual fan unit 14 includes a first fan 18 which draws fresh air from the surrounding ambient environment and directs the fresh air toward the inside of the crib 12 where a child normally lies. A second fan 20 draws any undesirable gases (e.g., carbon dioxide) present within the bottom of the crib 12 adjacent the child's head and exhausts that gas outside of the crib 12. The first and second fans 18, 20 reside within a housing 21. The dual fan unit 14 includes a first inlet 22 and a first outlet 24 in fluid communication with the first fan 18, such that when the first fan 18 operates, the fresh air is drawn in through the first inlet 22 and exits the dual fan unit 14 through the first outlet 24. Similarly, the dual fan unit 14 includes a second inlet 26 and a second outlet 28 in fluid communication with the second fan 20, such that when the second fan 20 operates, carbon dioxide within the crib 12 is drawn into the dual fan unit 14 through the second inlet 26 and exits the fan unit 14 through the second outlet 28. In this regard, the first inlet 22 and the second outlet 28 fluidly communicate with the ambient environment outside of the interior of the crib 12, while the first outlet 24 and second inlet 26 fluidly communicate with the environment within the interior of the crib 12.

The dual fan unit 14 may be configured such that the first fan 18 and second fan 20 are stacked vertically, as shown in FIG. 1. The stacked arrangement may align the first inlet 22 and second outlet 28 in a first vertical array, while the first outlet 24 and second inlet 26 may be arranged in a second vertical array. The fans 18, 20 themselves may be coaxially aligned about a common vertical axis. The fans 18, 20 may be bladed fans or bladeless fans.

The venting unit 16 is configured to deliver fresh air supplied by the first fan 18 into the crib 12 and draw in carbon dioxide from within the crib 12 and communicate that carbon dioxide to the second fan 20. In this regard, the venting unit 16 is complimentary to the dual fan unit 14, and comprises a first region 30 in communication with the first fan 18 and a second region 32 in communication with the second fan 20. According to one embodiment, the venting unit 16 is simply a structural member which delivers fresh air and draws in carbon dioxide or other undesirable gases. The venting unit 16 preferably includes a grate 34 so as to prevent large objects from becoming lodged within the venting unit 16 and inhibiting fluid flow through the system. The venting unit 16 preferably does not include any electrical components or moving components which may be dangerous to the child. In this regard, any electrical components or moving components (e.g., fan blades) are located in the dual fan unit 14, which is spaced from the interior of the crib 12 in a safe location out of the child's reach.

The venting unit 16 fluidly communicates with the dual fan unit 14 via a pair of conduits 36, 38. According to one embodiment, the conduits 36, 38 are preferably formed from flexible tubing so as to facilitate ease of routing of the conduits 36, 38 through the walls/slots of the crib 12. In another embodiment, the conduits 36, 38 may be formed from rigid, non-bendable tubing.

A first conduit 36 extends from the first outlet 24 on the dual fan unit 14 to the first region 30 of the venting unit 16 so as to communicate fresh air from the first fan 18 to the first region 30 of the venting unit 16. In this regard, the first conduit 36 is in fluid communication with the first fan 18 as well as the first region 30 of the venting unit 16. A second conduit 38 extends from the second region 32 of the venting unit 16 so as to communicate carbon dioxide drawn in to the second region 32 to the second fan 20 for exhausting outside of the crib 12. The second conduit 38 is in fluid communication with the second fan 20 and the second region 32 of the venting unit 16 so as to effectuate fluid communication therebetween.

The circulation unit 10 may optionally include one or more filters to purify the fluid exhausted by the circulation unit 10. In particular, a first filter may filter air expelled into the crib 12 from the first fan 18, while a second filter may filter air expelled away from the crib 12 from the second fan 20. The filter(s) may be located in the dual fan unit 14, the venting unit 16 or in the conduits 36, 38. The filter(s) may be a HEPA filter or other filter known by those skilled in the art.

Figure 2A:
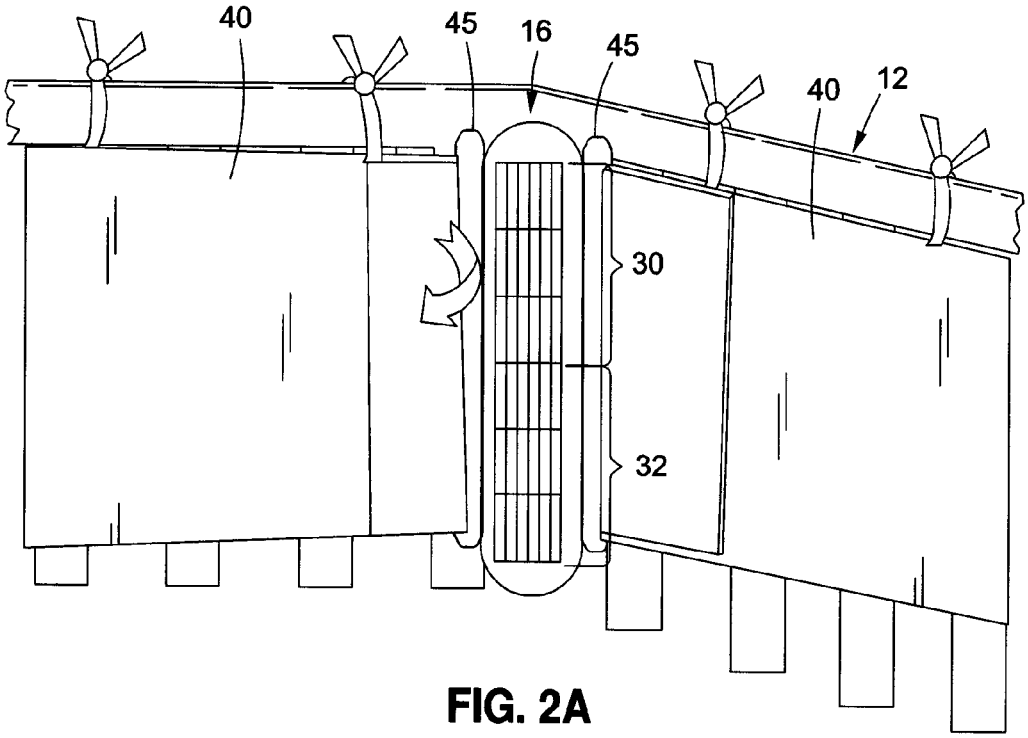
FIG. 2A is a perspective view showing the venting unit coupled to the bumpers in the crib.

Referring now specifically to FIGS. 2, 2A, and 3, the circulation unit 10 is connected to the crib 12 such that the venting unit 16 is positioned inside the crib 12, while the dual fan unit 14 is located outside the crib 12. As used herein, the term "inside the crib" generally refers to the area of the crib 12 wherein the child may reside. FIG. 2 is a front view of the crib 12, with one wall of the crib 12 removed to show the inside of the crib 12. As shown, the venting unit 16 is placed inside the crib 12, preferably in a corner by the bumpers 40 lining the walls of the crib 12. FIG. 2A shows the venting unit 16 in the corner of the crib 12, with the bumpers 40 extending through attachment loops 45 connected to the venting unit 16. The bumpers 40 extending around the attachment loops 45 are folded back upon themselves so as to secure the venting unit 16 to the bumpers 40. It is also understood that the bumper 40 may include ties or straps which may be used to connect the venting unit 16 thereto. The venting unit 16 is arranged such that the second region 32 is positioned adjacent the upper surface of the crib mattress 42, which is typically where carbon dioxide or other undesirable gases collect, and the first region 30 is positioned on top of the second region 32, extending toward the top of the crib 12.

FIG. 3 shows the outside of the crib 12, with the dual fan unit 14 mounted to an external portion of the crib 12. The backside of the venting unit 16 is shown, with the first and second conduits 36, 38 extending between the dual fan unit 14 and the venting unit 16. By mounting the dual fan unit 14 to an external portion of the crib 12, the dangerous operational components of the dual fan unit 14 (e.g., electrical components and fan blades) are out of the child's reach when the child is in the crib 12. The dual fan unit 14 is also preferably mounted high enough on the crib 12 such that if the child is playing outside of the crib 12, the child (particularly, young children) cannot easily reach the dual fan unit 12. The dual fan unit 14 may be mounted to the crib 12 using hardware (e.g., nails, screws, adhesives, straps, brackets, etc.) known by those skilled in the art.

Power is preferably supplied to the dual fan unit 14 via a rechargeable battery. In other embodiments, the dual fan unit 14 may be solar powered, powered via replaceable batteries, or powered via a power cord that is plug connectable into a conventional wall socket.

According to various embodiments, the circulation unit 10 may be configured to operate in any one of several different operational modes. In one embodiment, the circulation unit 10 includes an ON/OFF switch 35 to allow for manual operation thereof. More specifically, by turning the switch to the ON position, the first and second fans 18, 20 are turned on and operate continuously until the switch is subsequently moved to the OFF position. The circulation unit 10 may include a single ON/OFF switch 35 for controlling operation of the first and second fans 18, 20 (i.e., the first and second fans 18, 20 always operate in concert with each other). Alternatively, the circulation unit 10 may include separate ON/OFF switches for enabling separate and independent operation of the first and second fans 18, 20. In this regard, the user may turn the first fan 18 on, while leaving the second fan 20 off, or vice versa. The ON/OFF switch(es) may also enable control of the first and second fans 18, 20 in several different fan speeds, for instance, low speed, medium speed, or high speed.

Figure 4:
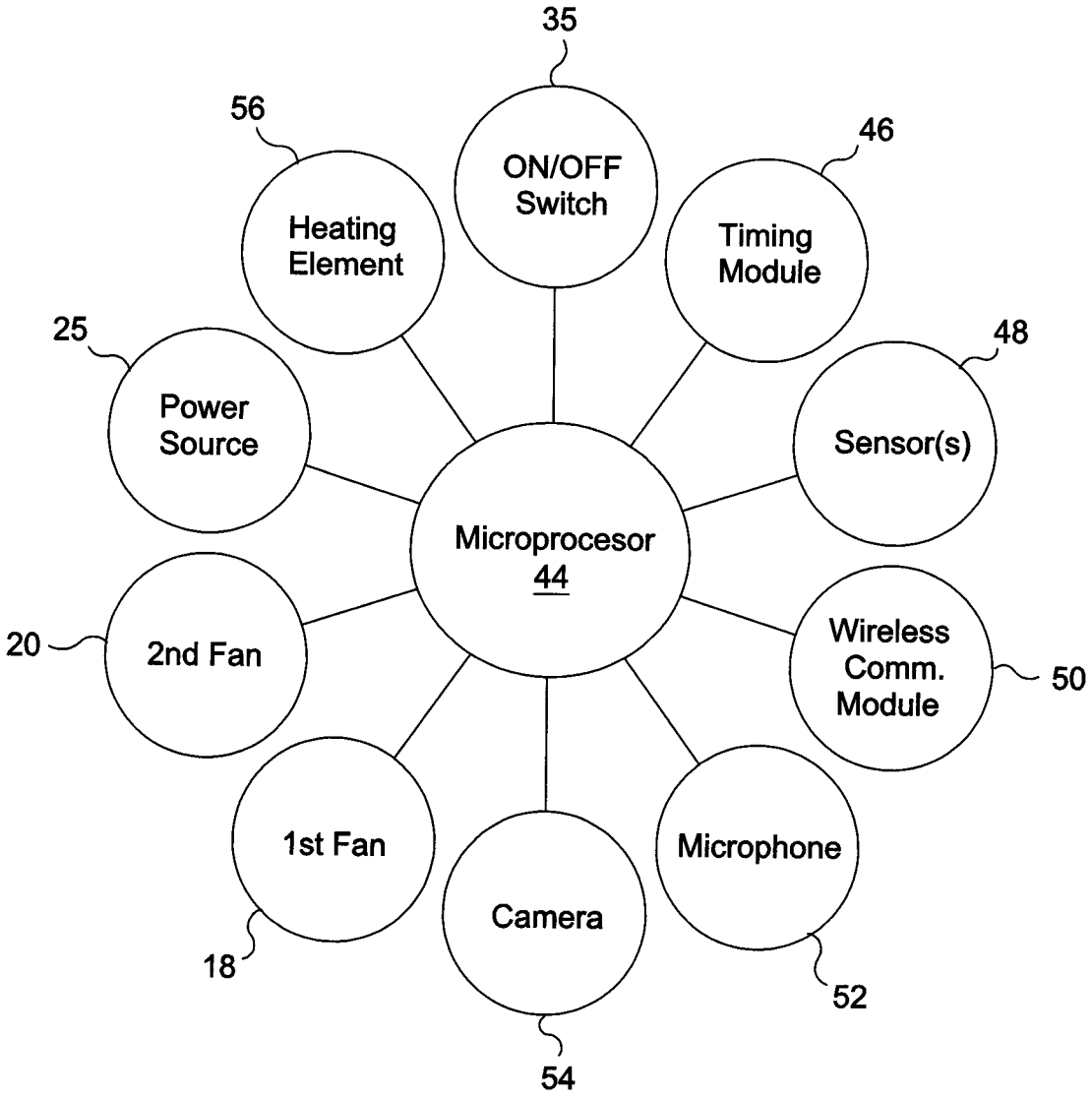
FIG. 4 is a schematic view of the electrical components associated with an embodiment of the circulation unit.

According to another embodiment, the circulation unit 10 may be more sophisticated to allow for advanced operational modes. In one implementation, the circulation unit 10 includes a microprocessor/controller in operative communication with the first and second fans 18, 20 for controlling operation of the fans 18, 20 in accordance with prescribed operational parameters. FIG. 4 is a schematic diagram showing the microprocessor 44 in communication with the power source 25, the ON/OFF switch 35, as well as several related components, as will be described in more detail below. The microprocessor 44 is preferably located onboard the dual fan unit 14, although the microprocessor 44 may be located external to the dual fan unit 14 without departing from the spirit and scope of the present invention.

According to one aspect of the invention, the microprocessor 44 is in operative communication with a programmable timing module 46, which enables the user to set the times which the fans 18, 20 operate. For instance, it may be desirable to operate the fans 18, 20 for a couple minutes every half-hour between a defined start time and a defined end time to flush carbon dioxide which may otherwise accumulate inside the crib 12. The timing module 46 may also have one or more pre-programmed operational modes which may be selected by the user.

According to another embodiment, the circulation unit 10 may be configured to operate autonomously (i.e., without input from the user) on an as-needed basis depending on the local environmental conditions within the crib 12. Along these lines, the circulation unit 10 may include one or more sensors for monitoring various local conditions. The sensors 48 are in operative communication with the microprocessor 44 which is programmed to operate the first fan 18 and/or second fan 20 when the sensors 48 sense a condition which exceeds a prescribed operational threshold. In other words, when the sensed local conditions within the crib 12 fall outside of acceptable limits, the circulation unit 10 begins to operate until the local conditions are within an acceptable range.

The sensors 48 incorporated into the circulation unit 10 may include, but are not limited to, a proximity sensor, an oxygen sensor, a carbon dioxide sensor, a temperature sensor, a light sensor. For instance, the oxygen sensor may be capable of sensing the oxygen levels within the crib 12. If the oxygen level is acceptable, the circulation unit 10 may remain off. However, if the oxygen sensor detects a low oxygen level, the microprocessor may communicate a signal to the fans 18, 20 to initiate operation. As the fans 18, 20 operate, the oxygen levels should begin to rise, and once the oxygen sensor detects an acceptable oxygen level, the microprocessor may communicate a signal to the fans 18, 20 to cease operation.

According to another aspect of the invention, the circulation unit 10 may be configured to enable remote monitoring and/or operational control through a wireless communication module 50 in communication with the microprocessor 44. The wireless communication module 50 may be capable of communicating in several different wireless communication protocols, such as Bluetooth™, WiFi, or other wireless communication protocols known by those skilled in the art. In this regard, a user may monitor operation of the circulation unit 10 on a remote computing device, such as a smartphone, tablet computer, PDA, desktop computer, laptop computer or other computing devices known in the art.

Given the widespread use of smartphones and tablet computers, the circulation unit 10 may be associated with a software application ("app.") (i.e., a set of computer executable instructions) that is downloadable on the smartphone or tablet computer to enable monitoring and operation of the circulation unit 10 via the smartphone or tablet computer. The software application may be capable of displaying the local conditions detected by the sensors 48, send alerts when the local conditions exceed prescribed thresholds, provide alerts as to the baby's movement (or lack thereof), provide power level updates (i.e., when the battery needs to be charged), provide updates as to when operational cycles begin and end. The software application may also be capable of serving as a baby monitor to provide visual or audible signals detected from within the crib 12. Along these lines, the circulation unit 12 may include a microphone 52 and/or a video camera 54 to detect audible and/or visual occurrences from within the crib 12. The microphone 52 and/or video camera 54 may be directly mounted to the venting unit 16 or the dual fan unit 14. Alternatively, the microphone 52 and/or video camera 54 may be separate units remote from the venting unit 16 and dual fan unit 14, and may be in operative communication with the microprocessor 44, such as via the wireless communication module 50, to allow for remote monitoring and operational control.

The software application may allow the user to control the circulation unit 10 remotely. For instance, the software application may provide a user interface on the remote computer (i.e., smartphone or tablet computer), which allows the user to control operation of the circulation unit 10. In particular, the user may turn the circulation unit 10 on or off, as well as modify programmed operational parameters.

It is also contemplated that the circulation unit 12 may include a heating element 56 in thermodynamic communication with the first fan 18 to enable heating of the fresh air blown into the crib 12. The heating element 56 is preferably located in the dual fan unit 14, and is thus located outside of the crib 12 and out of the child's reach. The heating element 56 may be in operative communication with a temperature sensor to automatically turn on when the sensed temperate falls below a prescribed threshold. The heating element 56 may also be remotely controlled by the user through the software application.

Figure 5:
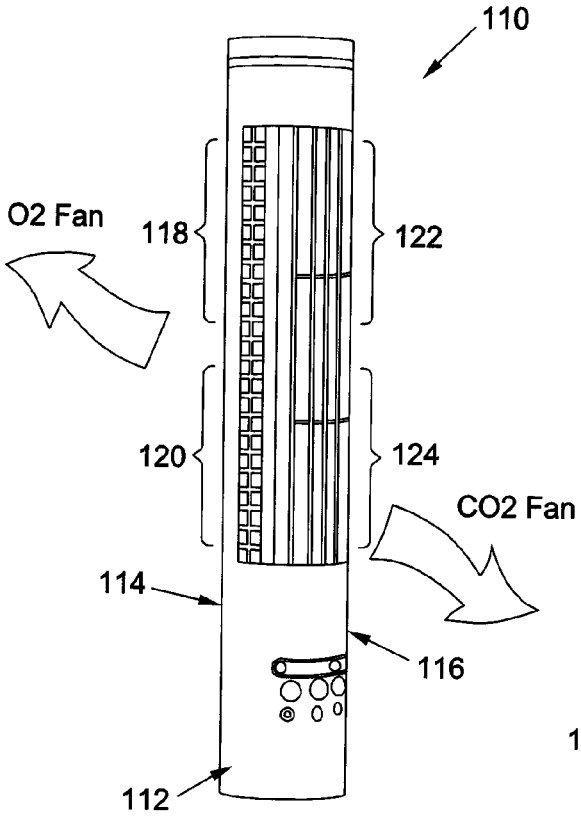
FIG. 5 is a front view of a second embodiment of a circulation unit.

Referring now specifically to FIG. 5, there is shown another embodiment of a circulation unit 110, which is a modified version of the dual-fan unit 14 described above. In particular, the circulation unit 110 is a single unit, and does not include separate fan and venting units. Rather, the circulation unit 110 essentially integrates the dual fan unit 14 and venting unit 16 described above in relation to the first embodiment of the circulation unit 10 into a single unit. Along these lines, the circulation unit 110 includes a housing 112 having a crib facing side 114 and an opposed outwardly facing side 116. The crib facing side 114 includes a first outlet 118 for blowing fresh air into the crib 12, and a second inlet 120 for drawing carbon dioxide from the crib 12. The outwardly facing side 116 includes a first inlet 122 for drawing in fresh air from the ambient environment and a second outlet 124 for expelling carbon dioxide away from the crib 12 and into the surrounding area. The circulation unit 110 includes first and second fans located within the housing 112 for creating the desired circulation.

The circulation unit 110 may be mounted on the crib 12 or placed on a supporting structure adjacent the crib 12, such as a nightstand or the like, and aimed such that the crib facing side 114 faces the crib 12 and the outwardly facing side 116 faces away from the crib 12. The circulation unit 110 is preferably arranged such that the crib facing side 114 faces the crib 12 with the second inlet 120 located adjacent the top surface of the crib mattress 42 to allow the second fan to draw in carbon dioxide or other undesirable gases which may accumulate within the crib 12. The first outlet 118 is located on top of the second inlet 120 to direct fresh air into the crib 12.

The circulation unit 110 is preferably powered by a rechargeable battery, although replaceable batteries or a power cord may also be used.

Figure 6:
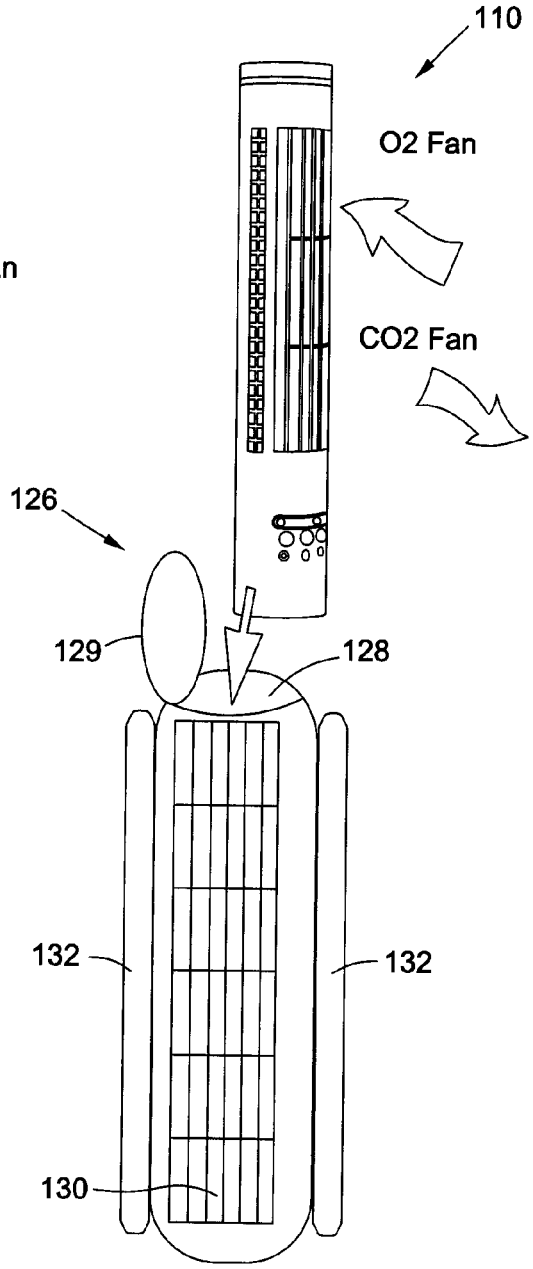
FIG. 6 is a front view of a soft cover unit configured for use with the circulation unit depicted in FIG. 5.
Figure 7:
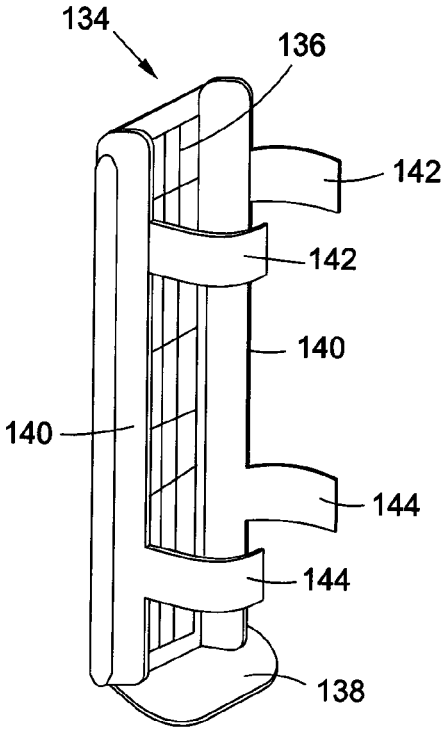
FIG. 7 is an upper perspective view of a snap-in cover unit configured for use with the circulation unit depicted in FIG. 5.
Figure 8:
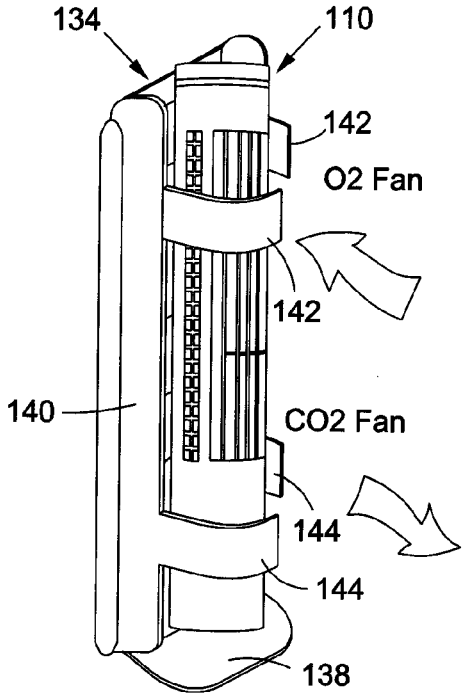
FIG. 8 is an upper perspective view of the circulation unit of FIG. 5 positioned within the snap-in cover unit depicted in FIG. 7.

Referring now to FIGS. 6-8, there is shown several optional cover units which may be used with the circulation unit 110 for securing the circulation unit 110 to the crib 12. FIG. 6 shows a first cover unit 126 comprised of a hard shell encased in a soft material to provide a soft external surface. The cover unit 126 defines an internal cavity 128 sized and configured to receive the circulation unit 110. A lid 129 may extend over the internal cavity 128 and may be pivotable between open and closed positions. The cover unit 126 further includes external openings 130 in communication with the internal cavity 128 to allow for circulation through the cover unit 126. One or more connecting loops 132 may be connected to the cover unit 126 to facilitate mounting of the cover unit 126 to the crib 12.

FIGS. 7 and 8 show a second cover unit 134 configured to allow the circulation unit 110 to snap-in the cover unit 134 for mounting of the circulation unit 110. The cover unit 134 includes a base plate 136 having a grate formed therein to allow for fluid flow through the base plate 136. An end plate 138 extends from one end of the base plate 138 for supporting the circulation unit 110. A pair of sidewalls 140 extend from the base plate 138 along the vertical edges thereof. A pair of first arms 142 and a pair of second arms 144 extend outwardly from the sidewalls 140 and toward the corresponding one of the first and second arms 142, 144 so as to capture the circulation unit 110 within the cover unit 134 when the circulation unit 110 is pressed therein. The first and second arms 142, 144 are flexible to allow the circulation unit 110 to snap into place within the cover unit 134 for maintaining the circulation unit 110 in a desired position.

Figure 9:
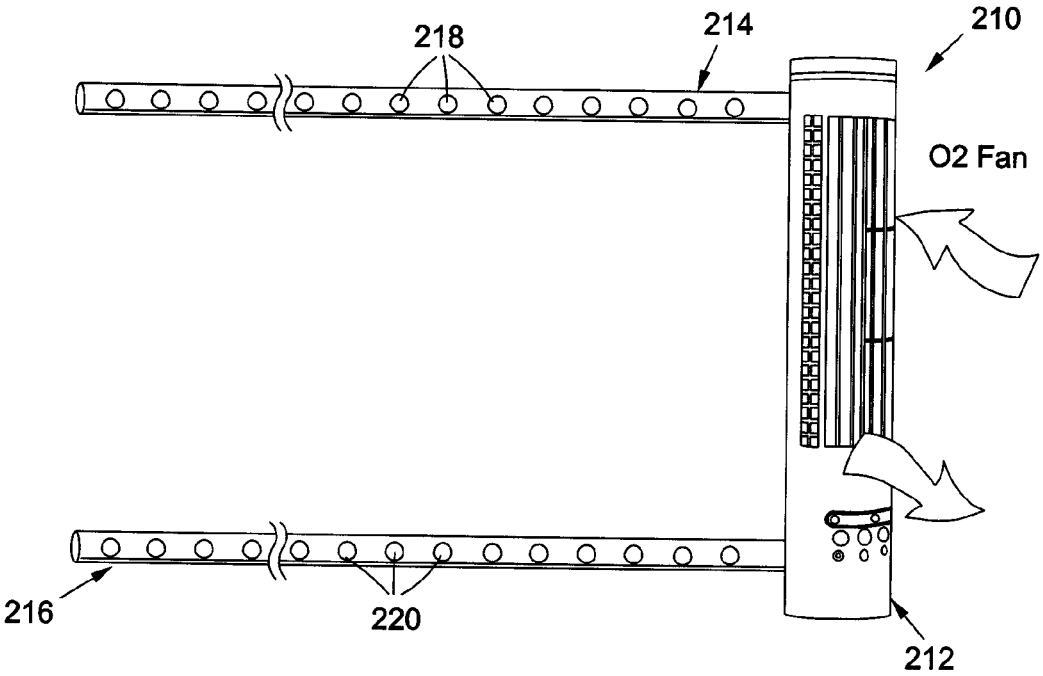
FIG. 9 is a schematic view of a third embodiment of a circulation unit including a dual unit fan and a pair of elongate fluid bars.

Referring now to FIG. 9, there is shown yet another embodiment of a circulation unit 210 having a dual-fan unit 212 and a pair of fluid bars 214, 216. The dual-fan unit 212 operates in a manner similar to the dual-fan unit 14 discussed above, and thus, the reader is directed to the foregoing discussion of the dual-fan unit 14 for a more detailed explanation of the structure and operation thereof The circulation unit 210 is unique in that it includes an elongate first fluid bar 214 in fluid communication with a first fan in the dual-fan unit 212 to supply fresh air into the crib 12, and an elongate second fluid bar 216 in fluid communication with a second fan in the dual-fan unit 212 to draw in dangerous gases which have accumulated within the crib 12. The first and second fluid bars 214, 216 may be placed along opposed edges of the crib 12, preferably within the crib along opposed longitudinal edges of the crib 12, although the fluid bars 214, 216 may also be placed along opposed latitudinal edges of the crib 12 or outside of the crib 12 without departing from the spirit and scope of the present invention. Each fluid bar 214, 216 includes a plurality of apertures 218, 220 which either delivery fresh air into the crib 12, or draw in dangerous gases from the crib 12. The elongate nature of the first and second fluid bars 214, 216 creates a fluid flow along a length of the crib mattress 42, rather than creating circulation from a single location. Furthermore, the opposed locations of the first and second fluid bars 214, 216 induces a planar fluid flow across the surface of the mattress 42 in a plane preferably within which the infant is located.

Figure 10:
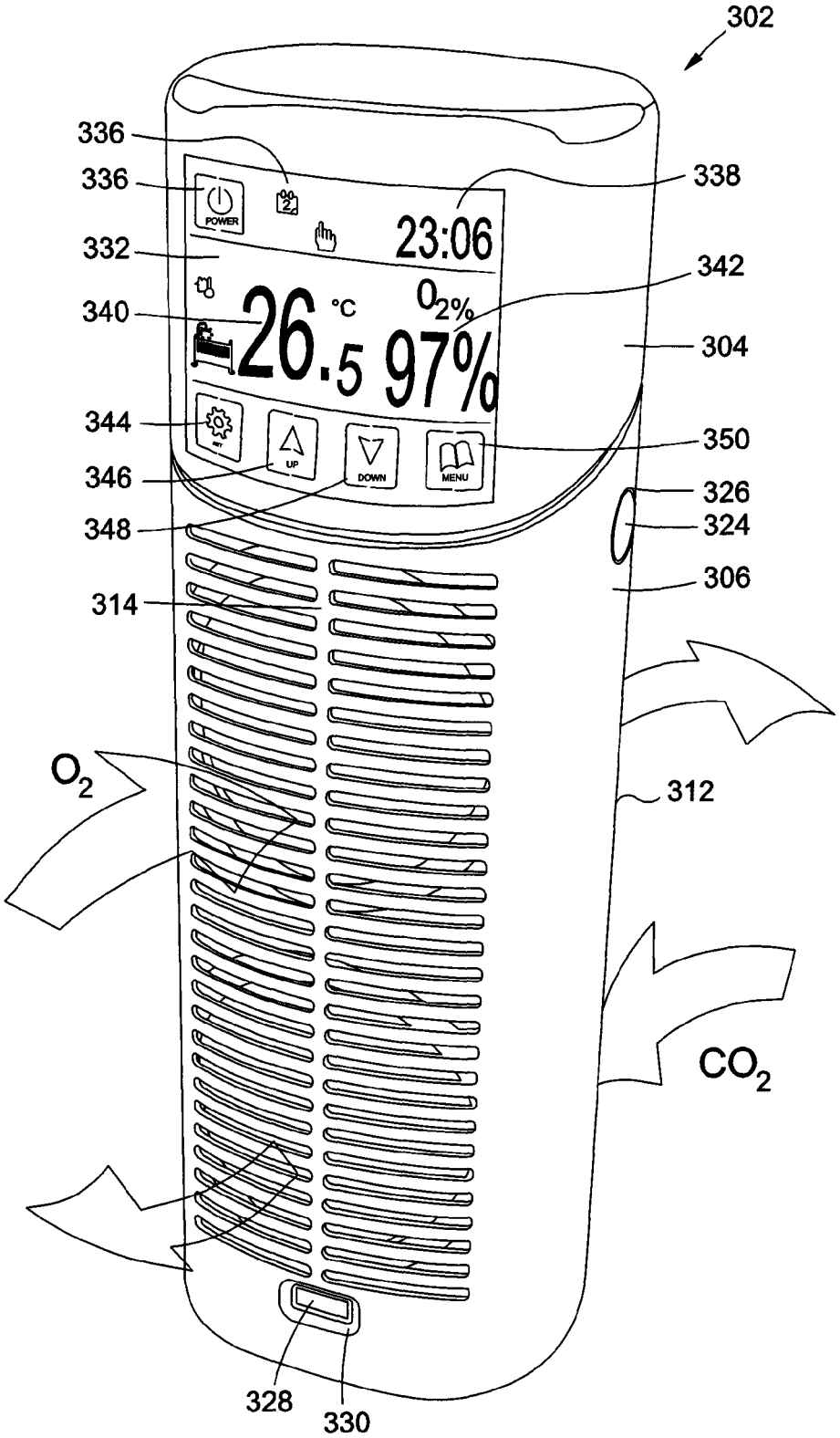
FIG. 10 is an upper perspective view of another embodiment of a circulation unit.
Figure 11:
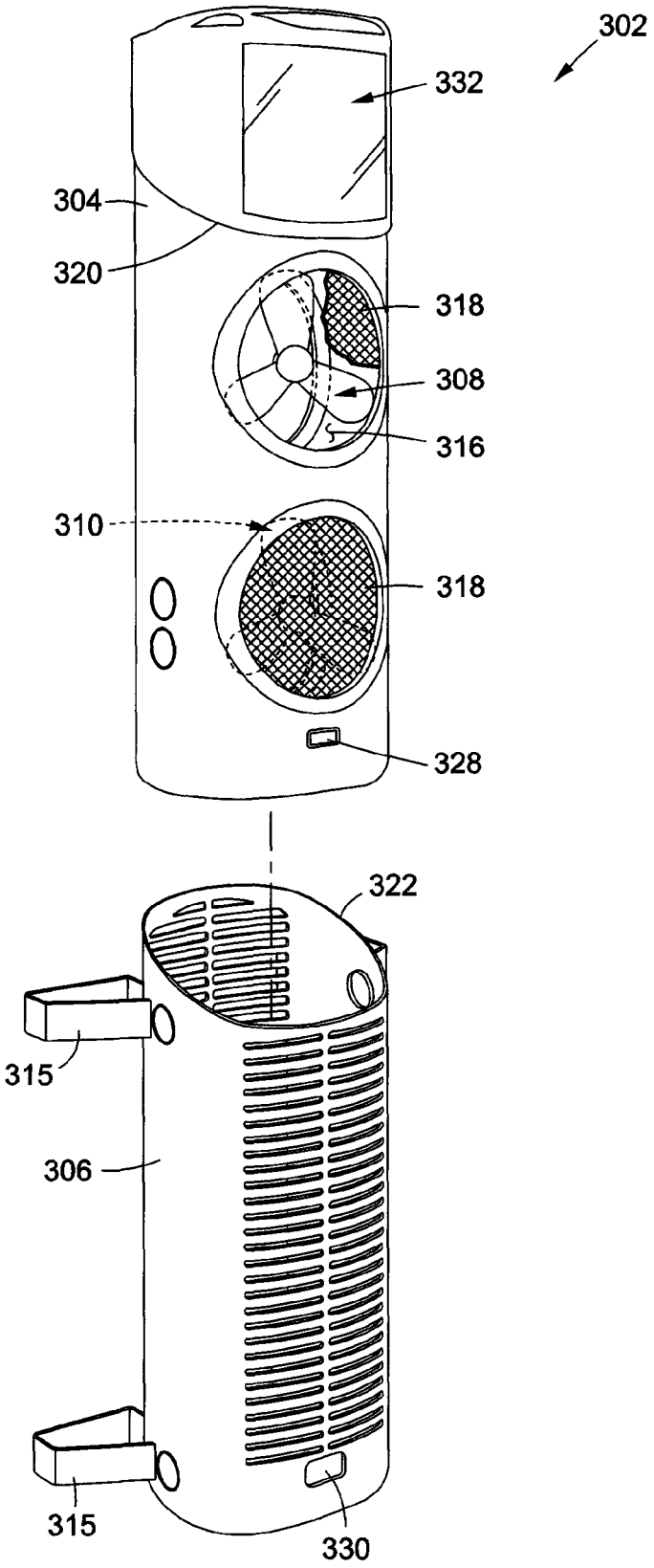
FIG. 11 is an exploded perspective view of the circulation unit, wherein a circulation unit housing is exploded from a circulation unit cover.

Referring now to FIGS. 10-11, there is depicted a circulation unit 302, which generally includes a housing 304 and a detachable cover 306. The housing 304 includes a lower portion that is insertable into the cover 306, wherein the lower portion houses a first fan 308 and a second fan 310. The circulation unit 302 is configured to be attachable to a crib 12 so as to define a crib facing side 312 and an opposing outwardly facing side 314. The first fan 308 is adapted to introduce fresh air into the crib 12 via the crib facing side 312, while the second fan 310 is adapted to remove dangerous gases which may collect within the crib 12 and expel such gases via the outwardly facing side 314. In this respect, the first and second fans 308, 310 are similar to the fans described above. The fans 308, 310 are located within respective openings 316 formed within the housing 304. A grate or mesh covering 318 may extend over the openings 316 to filter out large debris and to prevent inadvertent insertion of a finger or other objects into the openings 316. The fans 308, 310 and their respective openings 316 are preferably positioned in a vertical array, although the fans 308, 310 may be arranged in other configurations without departing from the spirit and scope of the present invention. Furthermore, although the exemplary embodiment shows a circulation unit 302 having only two fans 308, 310, it is understood that other embodiments of the circulation unit 302 may employ more than two fans.

The cover 306 is adapted to fit around the lower portion of the housing 304 (i.e., that portion of the housing including the fans 308, 310) and to engage with the crib 12. The cover 306 may include one or more attachment straps 315 which may wrap around a portion of the crib 12, such as a vertically extending crib bar. The cover 306 includes a grate or vents on the crib facing side 312, as well as the outwardly facing side 314 to allow for fluid communication through the circulation unit 302. In this respect, the cover vents are preferably positioned adjacent the fans 308, 310 to optimize fluid flow through the circulation unit 302. The cover vents are preferably small in size to prevent an infant from inserting their finger(s) into the vents.

The housing 304 and cover 306 are complimentary in shape so as to allow the housing 304 to be easily received within the cover 306. According to one embodiment, the housing 304 includes an enlarged upper section having a lower lip 320 which is complimentary in shape to a corresponding upper lip 322 formed on the cover 306. The housing 304 may be inserted into the cover 306 until the lower lip 320 of the housing 304 engages with the upper lip 322 of the cover 306.

The housing 304 and cover 306 may include one or more locking mechanisms which prevent a child from removing the housing 304 from the cover 306. For instance, the housing 304 may include a tab or button 324 which extends through a corresponding opening 326 formed in the cover 306. The button 324 and opening 326 may be sized and configured such that when the housing 304 is completely inserted into the cover 306, the button 324 snaps through the opening 326. In order to remove the housing 304 from the cover 306, the user simultaneously presses the button 324 and pulls up on the housing 304.

The circulation unit 302 may be powered by a rechargeable battery, and thus, the circulation unit 302 may include a port 328 for recharging the battery. The port 328 may be a USB port, a micro USB port or other ports known by those skilled in the art. In addition to charging the battery, the port 328 may be connectable to a cable (such as a USB cable) to connect the circulation unit 302 to a computer to enable programming of the circulation unit 302. For instance, a user may program several operational settings or preferences. The cover 306 may include a corresponding port opening 330 which is formed in the cover 306 such that when the housing 304 is completely inserted within the cover 306, the port opening 330 is aligned with the port 328 so as to enable insertion of a charging cable or programming cable into the port 328 through the port opening 330.

According to one embodiment, the circulation unit 302 additionally includes a user interface 332 which displays environmental information, operational information, and additionally allows a user to adjust various settings. In this respect, the circulation unit 302 embodies several of the components shown and described above in relation to FIG. 4. Referring specifically to FIG. 10, the user interface 332 includes a Power button 334 (e.g., an ON/OFF switch), a calendar icon 336, a clock 338, a temperature display 340, an Oxygen display 342, a settings button 344, an "UP" button 346, a "DOWN" button 348, and a "MENU" button 350. The Power button 334 may be used to turn the circulation unit 302 on and off. The calendar icon 336 may display the current date, or a date corresponding to particular programming, such as programming a particular setting for a date in the future. The clock 338 may display the current time, or a time associated with a program setting. The clock 338 may display the time in a 24-hour format (e.g., military time) or a 12-hour format (e.g., AM/PM). The temperature display 340 depicts the current temperature within the room, which may be displayed in Celsius, Fahrenheit or other temperature scales. The Oxygen display 342 depicts the detected oxygen levels. The settings button 344 allows the user to access basic preferences for the circulation unit 302 (e.g., language preference, clock preference, temperature preference, etc.). The UP and DOWN buttons 346, 348 allow the user to navigate the user interface and make user inputs. The MENU button 350 allows the user to access different operational settings, such as preprogrammed operational modes, adjusting fan speed or adjusting other adjustable operational features.

Figure 12:
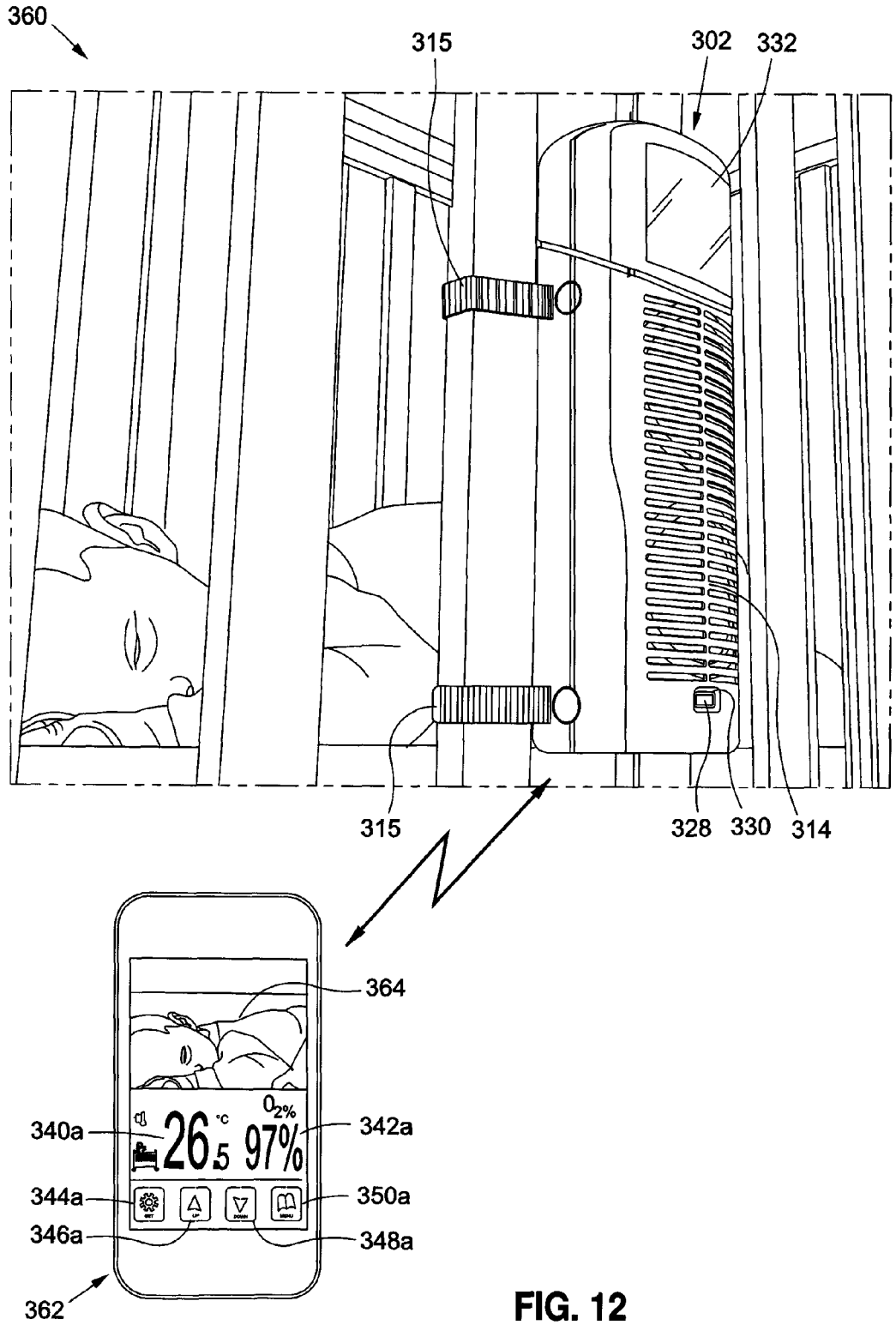
FIG. 12 is a schematic view of a ventilation system including the circulation unit of FIGS. 10 and 11 coupled to a crib, and a hand held mobile device which is configured to communicate with the circulation unit.

Referring now to FIG. 12, there is depicted a ventilation system 360 including the circulation unit 302 coupled to a crib 12 via the attachment straps 315, and a remote mobile computing device 362, such as a smartphone, tablet computer, smartwatch, or the like. The circulation unit 302 and the mobile computing device 362 communicate with each other via wireless communication to allow a user to remotely monitor and control operation of the circulation unit 302.

The mobile computing device 362 is capable of downloading a software application including a set of computer executable instructions for configuring the mobile computing device 362 to interface with the circulation unit 302 via wireless communication. In this respect, the mobile computing device 362 and circulation unit 302 may each include wireless transceivers capable of communicating in at least one of several different wireless communication protocols, including Bluetooth™, WiFi, or other protocols known by those skilled in the art.

According to one embodiment, the software application configures the mobile computing device 362 to operate as a remote user interface. As such, once the software application is downloaded onto the mobile computing device 362, the mobile computing device 362 may be capable of performing all of the functions of the user interface 332 described above. In this respect, software application may configure the mobile computing device 362 to include a temperature display 340*a*, an Oxygen display 342*a*, a settings button 344*a*, an "UP" button 346*a*, a "DOWN" button 348*a*, and a "MENU" button 350*a*. Although a power button, calendar, and clock are not shown on the mobile computing device 362, it is contemplated that the mobile computing device 362 may also display those features.

The mobile computing device 362 shown in FIG. 12 also includes a video display 364 of an image captured by a video camera coupled to the circulation unit 302. The mobile computing device 362 may also be capable of emitting sounds captured by a microphone coupled to the circulation unit 302. In this respect, in addition to functioning as a circulation device, the system 360 may also be capable of performing the functions of a conventional baby monitor.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A fluid circulation unit for use with a crib, the circulation unit comprising:

a housing adapted to be connectable to a crib so as to define a crib facing side and an opposing outwardly facing side, the crib facing side having a crib facing inlet and a crib facing outlet, the outwardly facing side having an outwardly facing inlet and an outwardly facing outlet;

a first fan coupled to the housing and in fluid communication with the outwardly facing inlet and the crib facing outlet, the first fan being configured to draw in ambient air through the outwardly facing inlet and direct the ambient air into the crib via the crib facing outlet; and a second fan coupled to the housing and in fluid communication with the crib facing inlet and the outwardly facing outlet, the second fan being configured to draw in gases from the crib through the crib facing inlet and expel the gases through the outwardly facing inlet.

2. The circulation unit recited in claim 1, further comprising a cover adapted to be selectively engageable with the housing, the cover having at least one opening in fluid communication with each of the crib facing inlet, the crib facing outlet, the outwardly facing inlet and the outwardly facing outlet when the cover is engaged with the housing.

3. The circulation unit recited in claim 1, further comprising an attachment member coupled to the housing and adapted to enable connection of the housing to the crib.

4. The circulation unit recited in claim 1, further comprising a user interface coupled to the housing, the user interface being adapted to enable a user to enter an operational command associated with operation of at least one of the first fan and the second fan.

5. The circulation unit recited in claim 4, wherein the user interface includes a display for displaying information associated with operation of at least one of the first fan and the second fan.

6. The circulation unit recited in claim 5, wherein the user interface includes a touch-screen display.

7. The circulation unit recited in claim 1, further comprising a battery coupled to the housing and in operative communication with the first fan and second fan for supplying power to the first fan and the second fan.

8. The circulation unit recited in claim 7, wherein the battery is a rechargeable battery.

9. The circulation unit recited in claim 8, further comprising a charging port incorporated into the housing and in operative communication with the rechargeable battery, the charging port being configured to be connectable to an external power source.

10. The circulation unit recited in claim 9, wherein the charging port is a USB port.

11. The circulation unit recited in claim 1, further comprising a wireless communication module coupled to the housing and operative to transmit a signal to a remote receiver.

12. The circulation unit recited in claim 1, further comprising a video camera coupled to the housing and configured to capture a video associated with a field of view including at least a portion of the crib.

13. The circulation unit recited in claim 1, further comprising an oxygen sensor coupled to the housing and adapted to measure an oxygen level adjacent the housing.

14. The circulation unit recited in claim 13, wherein operation of at least one of the first and second fans is associated with the oxygen level measured by the oxygen sensor.

15. The circulation unit recited in claim 1, further comprising a timing module in communication with the first and second fans, the timing module being configured to operate the first and second fans according to a prescribed operation schedule.

16. A ventilation system for controlling ventilation within a crib with a mobile communication device, the ventilation system comprising:

a circulation unit including:

a housing adapted to be connectable to a crib so as to define a crib facing side and an opposing outwardly facing side, the crib facing side having a crib facing inlet and a crib facing outlet, the outwardly facing side having an outwardly facing inlet and an outwardly facing outlet;

a first fan coupled to the housing and in fluid communication with the outwardly facing inlet and the crib facing outlet, the first fan being configured to draw in ambient air through the outwardly facing inlet and direct the ambient air into the crib via the crib facing outlet;

a second fan coupled to the housing and in fluid communication with the crib facing inlet and the outwardly facing outlet, the second fan being configured to draw in gases from the crib through the crib facing inlet and expel the gases through the outwardly facing inlet;

a controller coupled to the housing and in operative communication with the first and second fans for controller the first and second fans;

a wireless transceiver coupled to the housing and in operative communication with the controller; and a set of computer executable instructions downloadable onto the mobile communication device to configure the mobile communication device to wirelessly interface with the controller via the wireless transceiver for controlling operation of the first and second fans.

17. The ventilation system recited in claim 16, wherein the controller is configured to generate an informational signal associated with operation of the first and second fans, the set of computer executable instructions configuring the mobile communication device to receive the informational signal.

18. The ventilation system recited in claim 16, further comprising a cover adapted to be selectively engageable with the housing, the cover having at least one opening in fluid communication with each of the crib facing inlet, the crib facing outlet, the outwardly facing inlet and the outwardly facing outlet when the cover is engaged with the housing.

19. The ventilation system recited in claim 16, further comprising an oxygen sensor coupled to the housing, in operative communication with the controller, and adapted to measure an oxygen level adjacent the housing.

20. The ventilation system recited in claim 19, wherein operation of at least one of the first and second fans is associated with the oxygen level measured by the oxygen sensor.

* * * * *